United States Patent [19]

Porterfield et al.

[11] 4,140,407

[45] Feb. 20, 1979

[54] RIBBON FEED MECHANISM RESPONSIVE TO CASE SHAFT MECHANISM AND PRINTING MECHANISM

[75] Inventors: Richard F. Porterfield; Richard E. Shattuck, both of Cortland, N.Y.

[73] Assignee: SCM Corporation, New York, N.Y.

[21] Appl. No.: 825,736

[22] Filed: Aug. 18, 1977

[51] Int. Cl.[2] ..... B41J 35/12

[52] U.S. Cl. ..... 400/216.6; 400/208; 400/212; 400/225; 400/236; 400/259; 400/266; 400/375

[58] Field of Search ..... 197/17, 33, 71, 73, 197/151, 155

[56] References Cited

U.S. PATENT DOCUMENTS

| | | | |
|---|---|---|---|
| 1,067,664 | 7/1913 | Kurowski | 197/151 |
| 2,291,750 | 8/1942 | Noxon et al. | 197/155 |
| 3,981,385 | 9/1976 | Mueller et al. | 197/17 |

*Primary Examiner*—Ernest T. Wright, Jr.

*Attorney, Agent, or Firm*—Kenneth W. Greb; Ernest F. Weinberger; Milton M. Wolson

[57] ABSTRACT

A ribbon feed mechanism for a typewriter has a linkage for incrementally feeding a ribbon, a power roll rotated by a motor and a control member actuated by a printing mechanism for connecting the power roll to the linkage to incrementally feed the ribbon. The control member is also actuated by a carriage shift mechanism when shifting a carriage from an upper case position to a lower case position for connecting the power roll to the linkage to incrementally feed the ribbon.

10 Claims, 13 Drawing Figures

RIBBON FEED MECHANISM RESPONSIVE TO CASE SHAFT MECHANISM AND PRINTING MECHANISM

BACKGROUND OF THE INVENTION

The present invention relates to typewriters, and more particularly to a ribbon feed mechanism operable to incrementally feed a ribbon in response to actuating a printing mechanism and in response to shifting a carriage from an upper case position to a lower case position.

In typewriters which shift a carriage from a lower to an upper case position for printing upper case characters, a ribbon vibrator lifts a ribbon to a first elevation. When a printing mechanism is actuated, the ribbon vibrator lifts the ribbon to a second elevation higher than the first elevation for printing an upper case character. When the ribbon is supported on an arm which is pivotally supported on a ribbon cartridge, the printing character strikes the ribbon at an angle relative to the length of the ribbon expending that area of the ribbon. This expended area of the ribbon can overlap the next printed character when the carriage is returned for printing a lower case character. When a fabric ribbon is used, an overlapping of printing characters does not noticably affect the density of the printed characters. However, when a carbon ribbon is used, overlapping of printed characters omits printing, which is highly undesirable.

This problem could be avoided by having the printing mechanism feed the carbon ribbon with larger increments than necessary for normal printing. Feeding larger increments would be undesirable since the carbon ribbon, which is fed past the print point only once, would be inefficiently used.

The present invention avoids the problem of overlap printing and maintains efficient use of the carbon ribbon by feeding the ribbon one additional increment when actuating a carriage shift mechanism to return the carriage from the upper case position to the lower case position.

SUMMARY OF THE INVENTION

The present invention is a ribbon feed mechanism for a typewriter which has a carriage shiftable between lower and upper case positions for printing lower and upper case characters. The typewriter has a carriage shift mechanism powered by a motor for shifting the carriage between the lower and upper case positions. A ribbon is supported in the typewriter for incremental feeding movement. The typewriter has a printing mechanism for printing the lower and upper case characters.

The ribbon feed mechanism has a linkage operatively connected to the ribbon for incrementally feeding the ribbon. A toothed power roll powered by the motor is the power source for driving the linkage. A control means including a bellcrank is operable to couple the linkage with the power source for incrementally feeding the ribbon. The bellcrank is pivoted by the actuation of a printing mechanism causing the ribbon to feed one increment. The bellcrank is also pivoted by the actuation of the carriage shift mechanism when returning the carriage from the upper case position to the lower case position causing the ribbon to feed one increment.

Accordingly, it is an object of the present invention to provide a ribbon feed mechanism actuated by a carriage shift mechanism to prevent overlap printing when shifting the carriage from an upper to a lower case position.

A further object of the present invention is to provide an economical and efficient ribbon feed mechanism by having the same linkage and power source actuated by a carriage shift mechanism to incrementally feed the ribbon and actuated by a printing mechanism to incrementally feed the ribbon.

Other objects, features, and advantages of the invention will become more apparent from the following description, including the appended claims and the accompanying drawing.

BRIEF DESCRIPTION OF THE DRAWING

FIG. 6 is an enlarged right side elevational view of a portion of the clutch used with the carriage shift mechanism and a portion of the control means used with the ribbon feed mechanism.

DESCRIPTION OF THE PREFERRED EMBODIMENT

Figure 1:
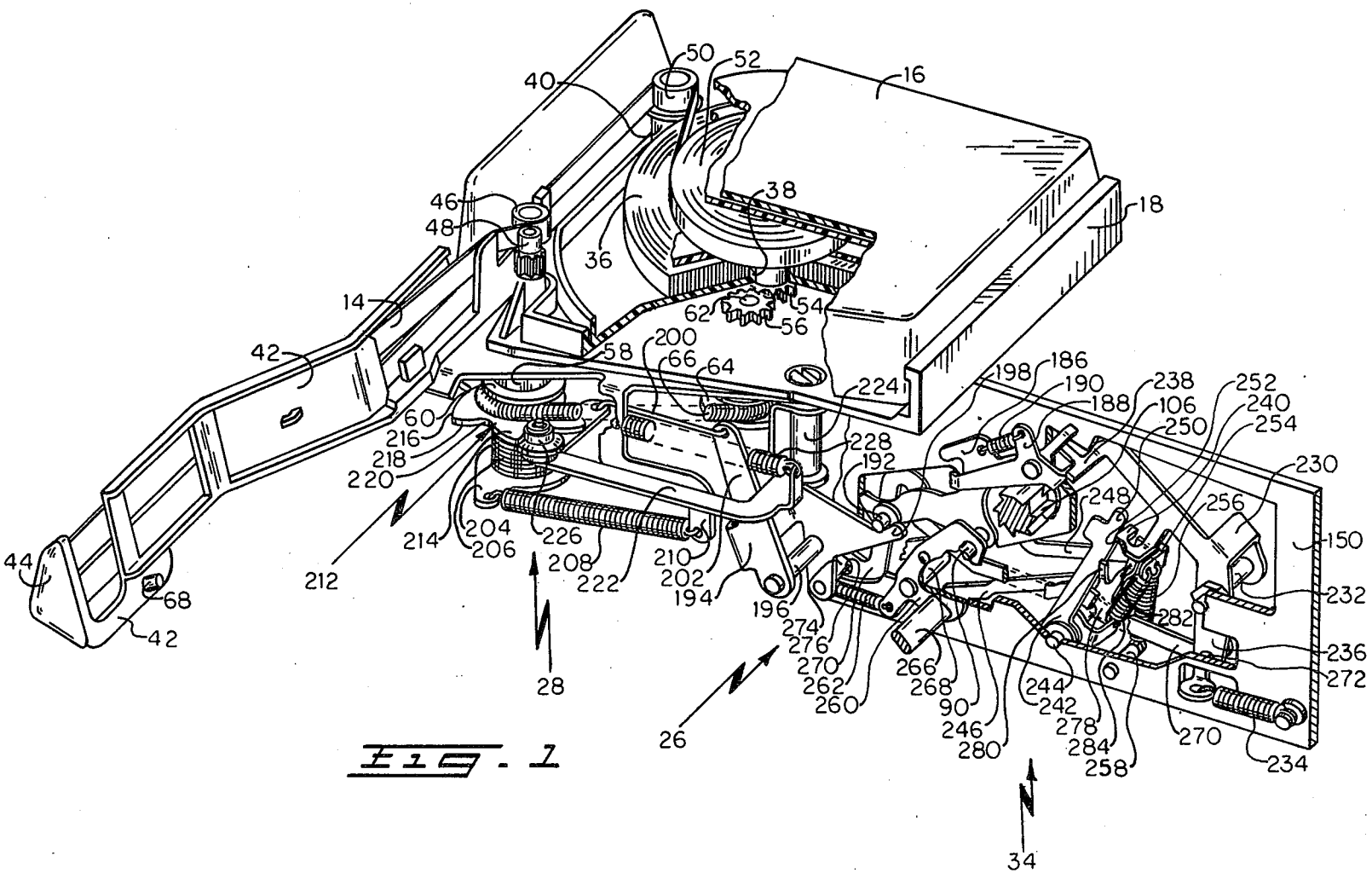
FIG. 1 is a front perspective view of the ribbon feed mechanism made in accordance with the present invention.
Figure 2:
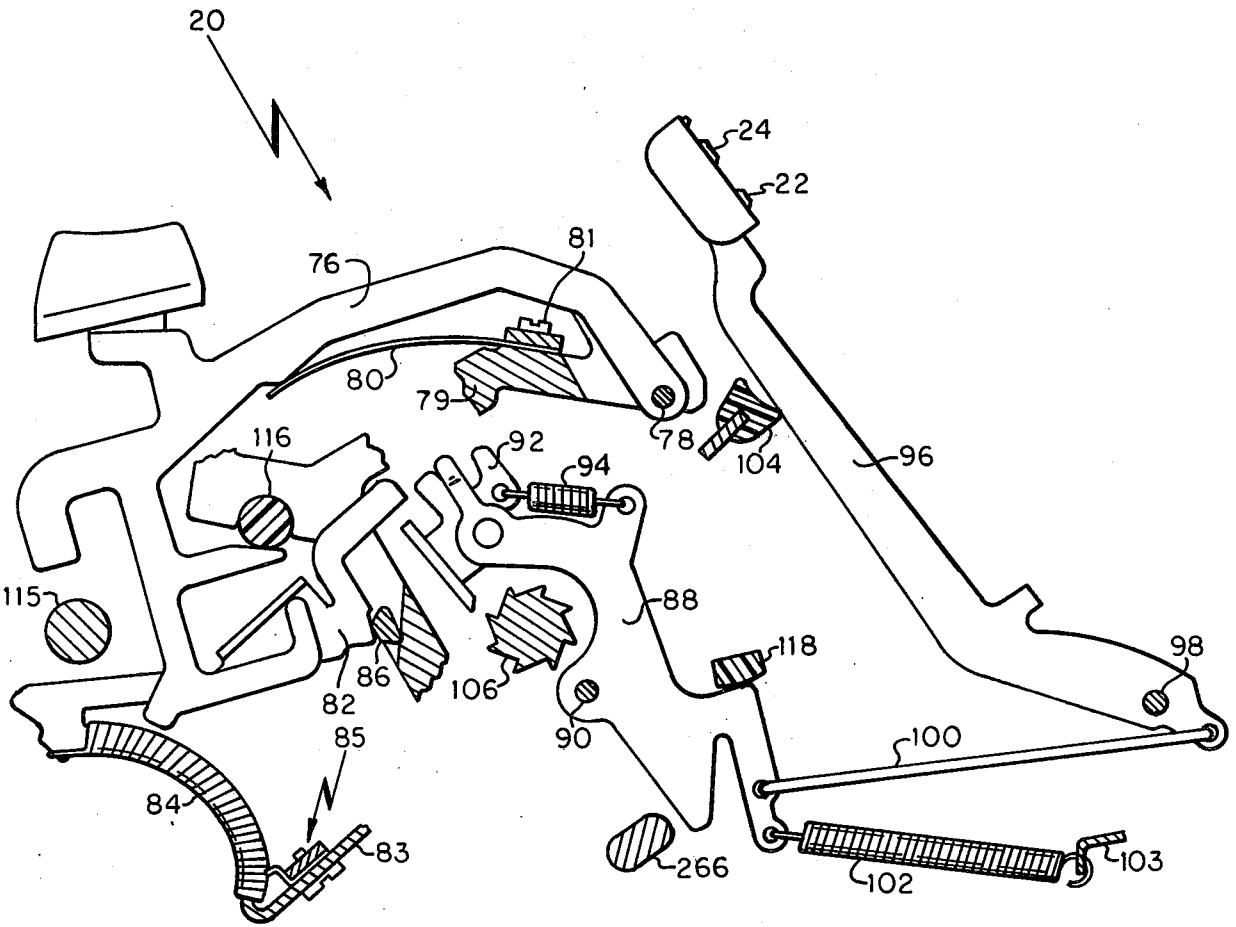
FIG. 2 is a right side elevational view of the printing mechanism.
Figures 3, 13:
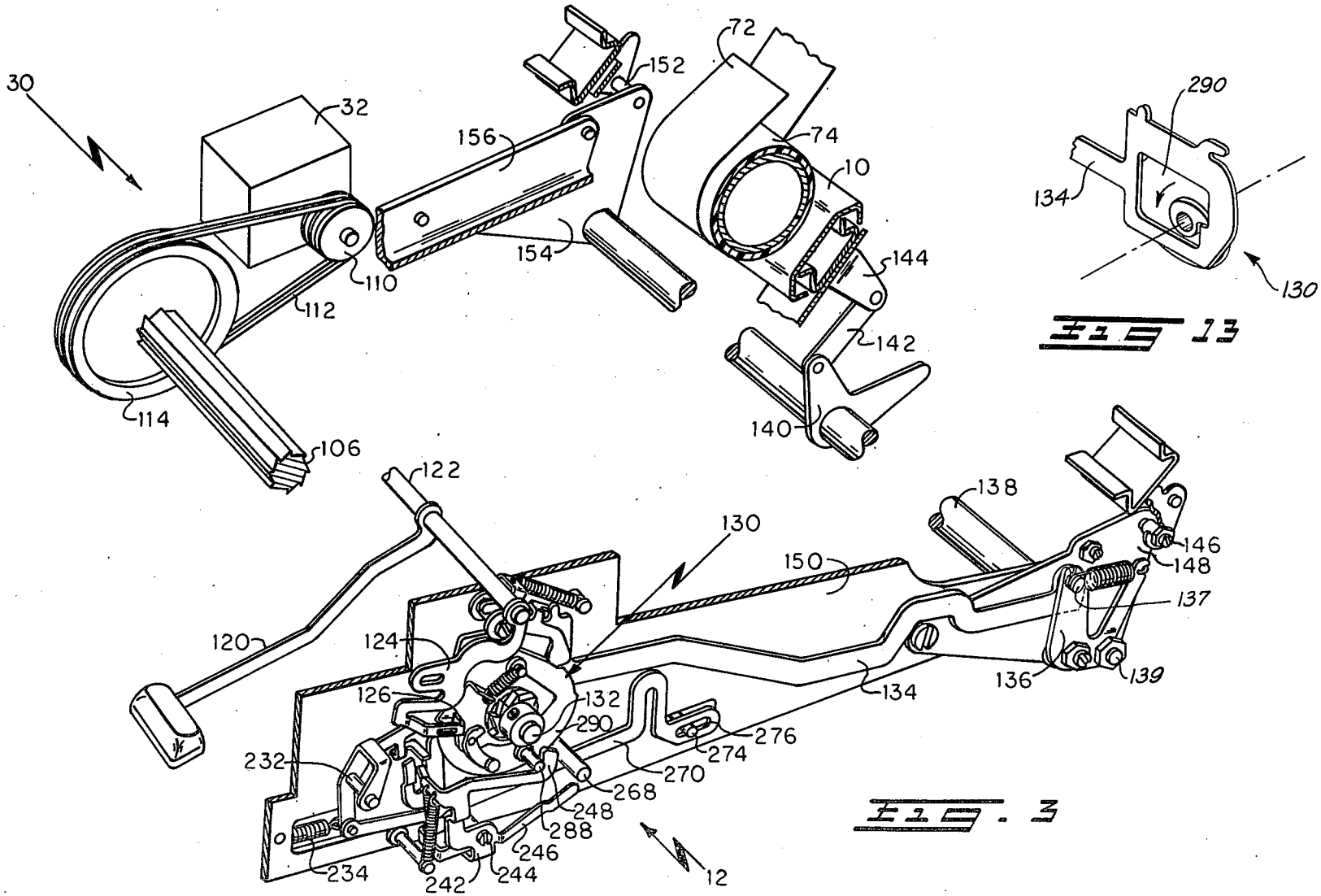
FIG. 3 is a front perspective view of the carriage shift mechanism.
FIG. 13 is a perspective view of portions of the shift clutch and a connecting link.
Figure 4:
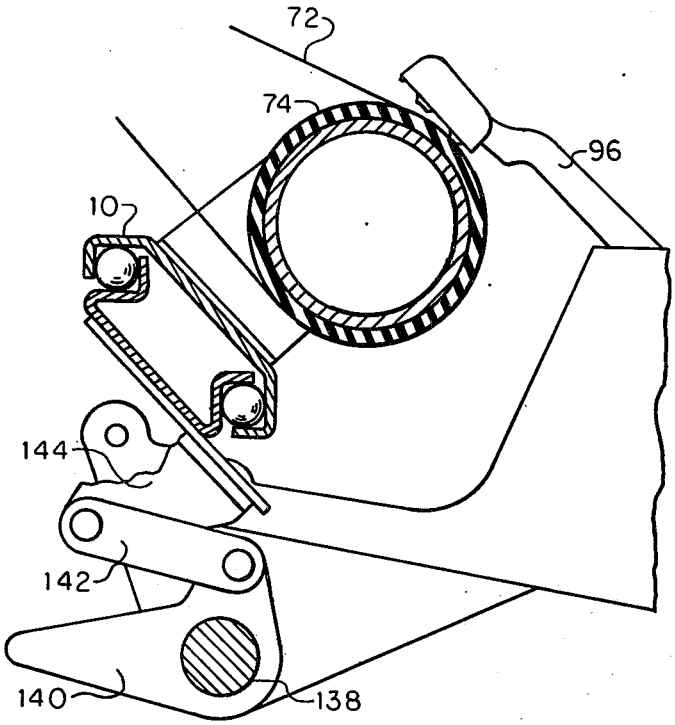
FIG. 4 is a left side elevational view of the carriage in the lower case position.
Figure 5:
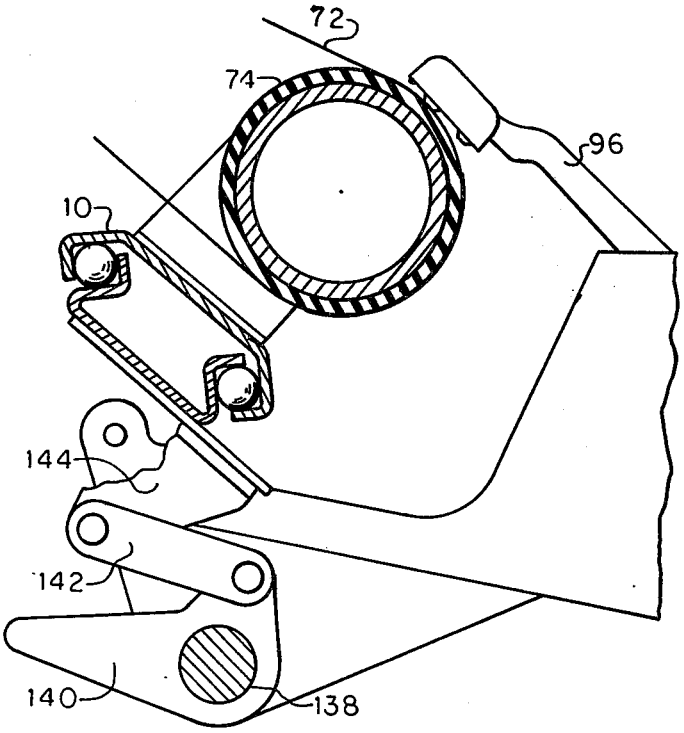
FIG. 5 is a left side elevational view of the carriage in the upper case position.
Figure 5:
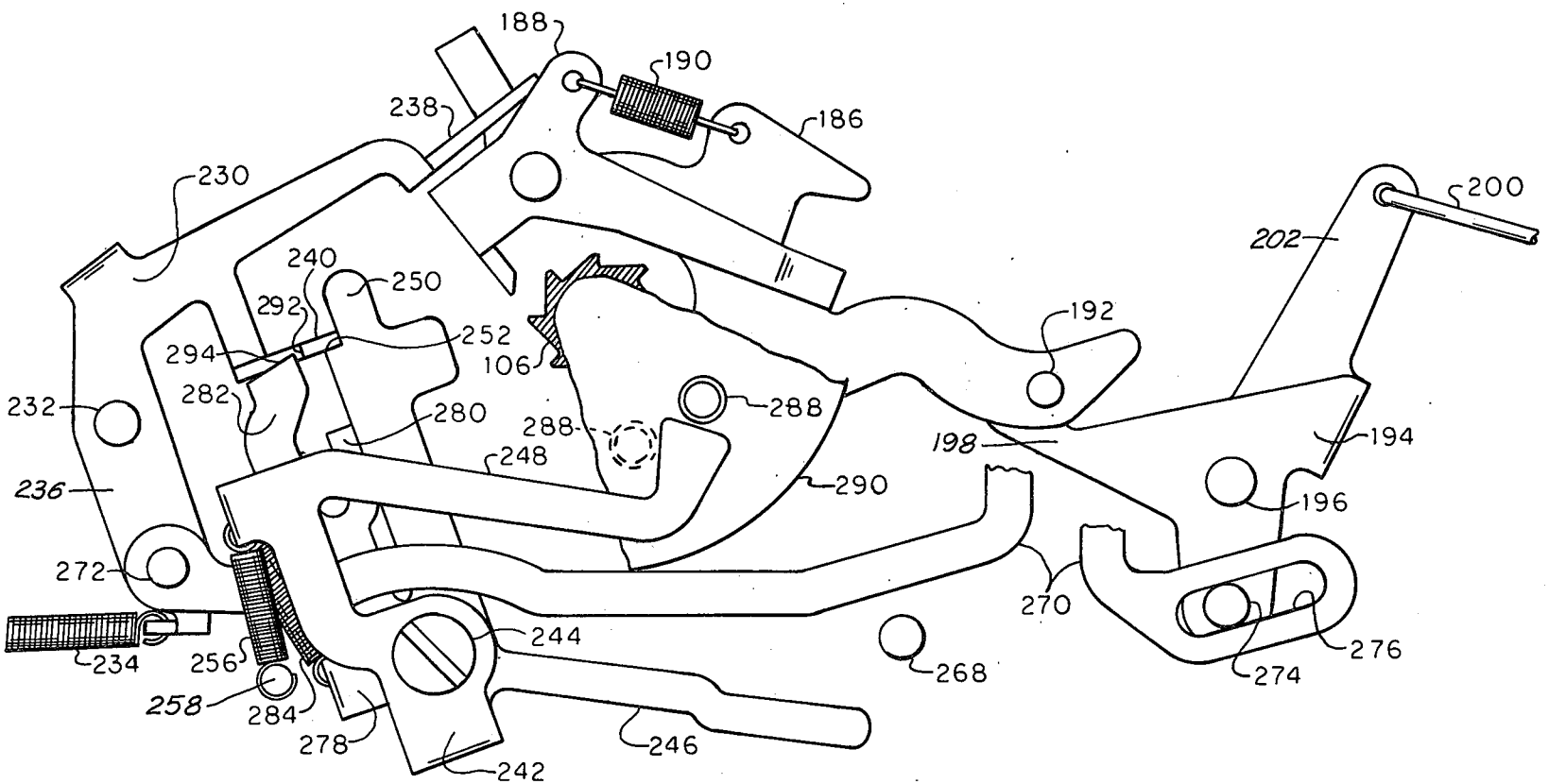

In the illustrated embodiment of FIGS. 1, 2 and 3, the typewriter has a carriage 10 shiftable between a lower case position (FIG. 4) and an upper case position (FIG. 5). A carriage shift mechanism 12 is connected to the carriage 10 for shifting the carriage 10 between the lower and upper case positions. A ribbon 14 is supported in the typewriter by a ribbon cartridge 16 attached to a cartridge support 18 for incremental feeding movement. A printing mechanism 20 is operable for printing lower case characters 22 and upper case characters 24. A ribbon feed mechanism 26 includes a linkage 28 connected to the ribbon 14, a power source 30 rotated by a motor 32 and a control means 34. The control means 34 is operable to couple the linkage 28 to the power source 30 for incrementally feeding the ribbon 14 in response to the actuation of the printing mechanism 20 and in response to the actuation of the carriage shift mechanism 12.

RIBBON

Referring to FIG. 1, the ribbon 14 is installed into the typewriter by the cartridge 16. In the present embodiment, the ribbon 14 is a carbon ribbon. However, a fabric ribbon would function equally as well with the present invention. A supply spool 36 of the ribbon 14 is rotatably supported on a hub 38 in the cartridge 16. The ribbon 14 is threaded around a roller 40, along an arm 42, reversed in direction at the end 44 of the arm 42, again along the arm 42, between a pinch roller 46 and a drive roller 48, around a roller 50 and on to a take-up spool 52. The take-up spool 52 has a gear 54 in mesh with a pinion 56 attached to the support 18. A shaft 58, which supports and drives the drive roller 48 also supports and drives a pulley 60. Another shaft 62, which supports the pinion 56, also supports a pulley 64. A closed loop coil spring 66 connects the pulley 60 with the pulley 64.

The ribbon 14 is incrementally fed by the linkage 28 driving the drive roller 48 which pulls the ribbon 14 from the supply spool 36. The ribbon 14 is advanced on to the take-up spool 52 by the drive from the shaft 58 through the spring 66 and the pinion 56.

The arm 42 of the cartridge 16 has a pin 68 projecting therefrom for engaging a ribbon lift mechanism 70 which will be hereinafter described.

PRINTING MECHANISM

The printing mechanism 20 is operable to print lower and upper case characters 22,24 by striking the ribbon 14 against a work sheet 72 backed by a platen 74 (FIG. 3). Referring to FIG. 2, in the present embodiment, the printing mechanism 20 includes several independent typebars 96 (only one shown), each carrying a single lower and upper case character 22,24. It is understood that the printing mechanism could include a print element, which carries several lower and upper case characters as well as numbers and symbols, and function equally as well with the present invention.

The printing mechanism 20 has a keylever 76 pivotally supported on a shaft 78. A leaf spring 80 is rigidly attached to a frame member 79 by a screw 81. The spring 80 biases the keylever 76 in a non-operated position. An interposer 82 is supported at one end by a coil spring 84. The spring 84 is securely attached to a bracket 83 by a screw assembly 85. The spring 84 biases the interposer 82 near another end against a shelf 86. An actuator 88 is pivotally supported on a shaft 90. A pawl 92 is pivotally supported on the actuator 88. A spring 94 biases the pawl 92 to a limited position in a clockwise direction. A typebar 96 is pivotally supported on a shaft 98. A link 100 connects the actuator 88 to the typebar 96. A spring 102 connected at one end to a spring anchor 103 biases the actuator 88 to a limited positiion in a counter-clockwise direction. A typebar rest 104 supports the free end of the typebars 96 in a non-operated position. The typebar 96 carries the lower case character 22 and the upper case character 24. The power source 30 (FIG. 3) includes a power roll 106 rotated by the motor 32 through a motor pulley 110, a belt 112 and a power roll pulley 114.

When the keylever 76 is depressed to a lower limit determined by the keylever 76 abutting a down stop 115, the keylever 76 drives the spring 84 downward. The spring 84 pulls the interposer 82 off the shelf 86 and biases the interposer 82 clockwise. The interposer 82 pivots the pawl 92 counter-clockwise into engagement with the power roll 106. The power roll 106 pivots the actuator 88 clockwise which, in turn, pivots the typebar 96 by the link 100 to print a character 22,24.

When the keylever 76 is released, the leaf spring 80 biases the keylever 76 upwards to a limited position determined by the keylever 76 abutting an up stop 116. The keylever 76 lifts the interposer 82 upward and the spring 84 biases the interposer 82 against the shelf 86. The pawl 92 disengages from the power roll 106 after a predetermined amount of drive has been transmitted to the typebar 96. The spring 102 returns the actuator 88 counter-clockwise to rest against an abutment 118. The biased actuator 88 returns the typebar 96 to rest against the typebar rest 104. The printing mechanism 20 is thereby restored to its non-operative position.

CARRIAGE SHIFT MECHANISM

Referring to FIGS. 3 and 6, the carriage shift mechanism 12 is operable to shift the carriage 10 between a lower case position (FIG. 4) and an upper case position (FIG. 5). The carriage shift mechanism 12 has a keylever 120 supported for pivotable movement about an axis of a shaft 122. An arm 124 is rigidly connected to the shaft 122. A finger 126 formed at the free end of the arm 124 is operable to couple a conventional mechanical clutch 130 to a motor powered shaft 132, which is an extension of the power roll 106. A link 134 is connected to its forward end to the clutch 130 by a plate 290 and is connected at its rearward end to a lift cam 136 by a stud 137. The lift cam 136 is rigidly connected to a shaft 138 by a nut 139. An arm 140 is rigidly connected to the shaft 138. A link 142 is connected to the arm 140 and is connected to a bracket 144. The bracket 144 is rigidly attached to the carriage 10. The carriage 10 is pivotally supported at one end by a shoulder screw 146 on a bracket 148, which is rigidly attached to a side frame 150. The carriage 10 is pivotally supported at the other end by a shoulder screw 152 on a bracket 154, which is rigidly attached to a second side frame 156.

When the keylever 120 is depressed, the arm 124 pivots counter-clockwise about the axis of the shaft 122. This movement of the arm 124 couples the clutch 130 to the shaft 132. The clutch 130, while rotating nearly a complete revolution, pulls the link 134 forward which pivots the lift cam 136 counter-clockwise about the axis of the shaft 138. The lift cam 136 pivots the shaft 138 and the arm 140 counter-clockwise. The arm 140 pulls the link 142 forward which causes the bracket 144 to pivot the carriage 10 clockwise about the shoulder screws 146 and 152. The carriage 10 has now been shifted from the lower case position (FIG. 4) to the upper case position (FIG. 5).

When the keylever 120 is released from the depressed position, the clutch 130 rotates a few degrees to complete one revolution. The clutch 130 then releases the link 134. The carriage 10 pivots counter-clockwise back to the lower case position (FIG. 4). The counter-clockwise movement of the carriage 10 is caused by gravity due to a substantial portion of the carriage weight being located on a left side (forward) of the shoulder screws 146 and 152. The link 134 is returned rearward by the carriage 10 returning to the lower case position.

RIBBON LIFT MECHANISM

Figure 7:
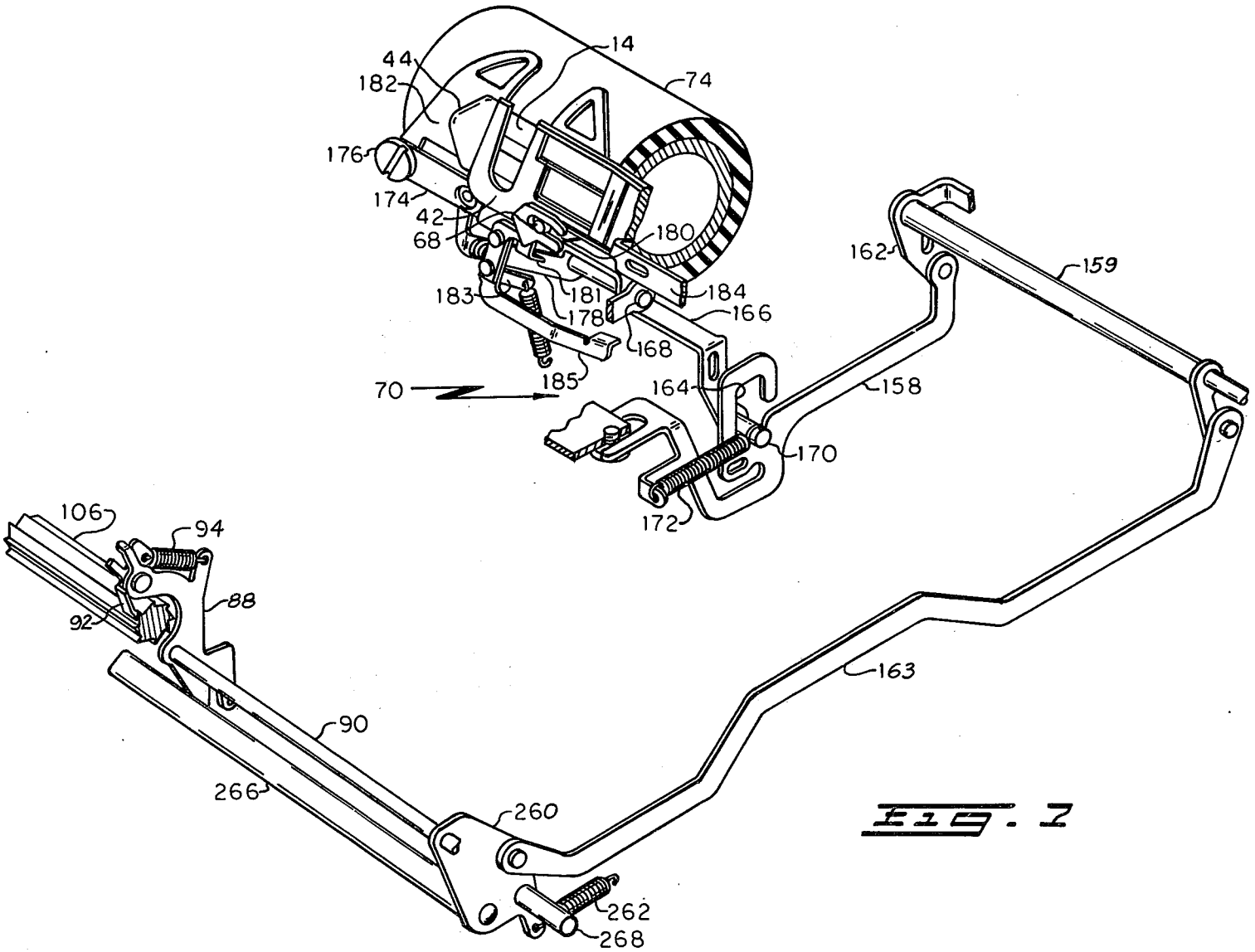
FIG. 7 is a perspective view of the ribbon lift mechanism.
Figure 8:
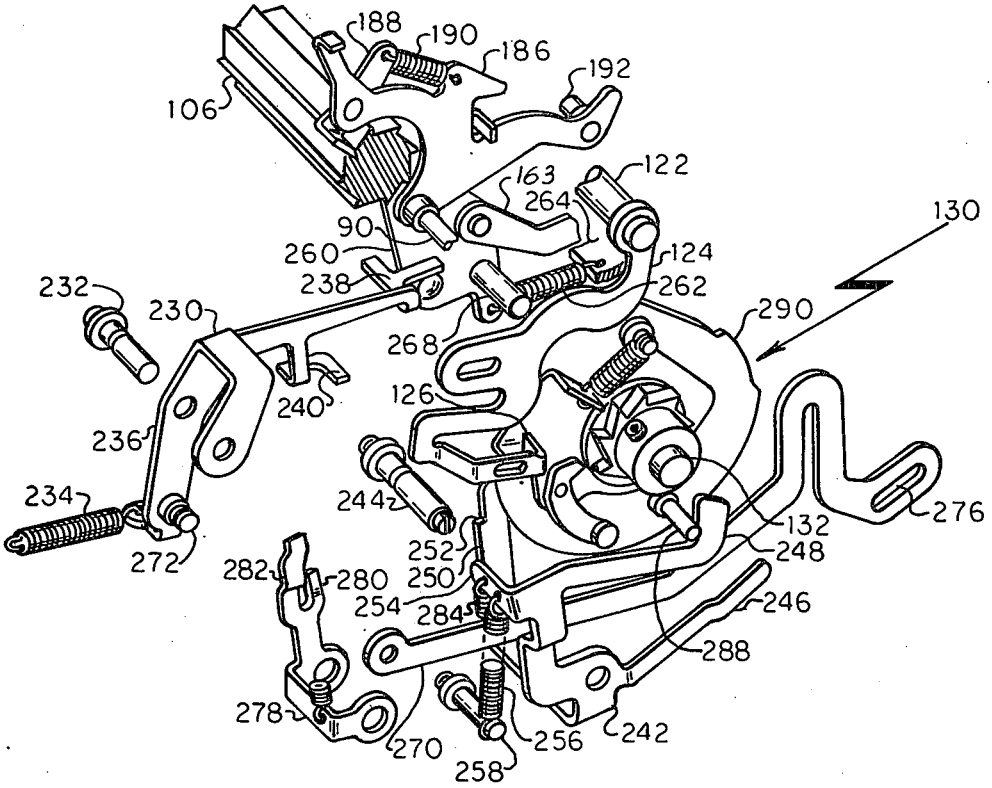
FIG. 8 is an enlarged perspective view partially exploded of the control means used with ribbon feed mechanism.
Figure 9:
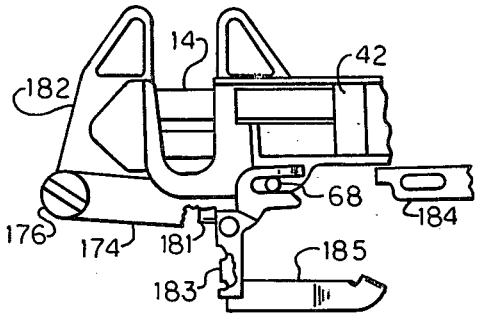
FIG. 9 is a front elevational view of the cartridge arm located in the lower case non-print position.
Figure 11:
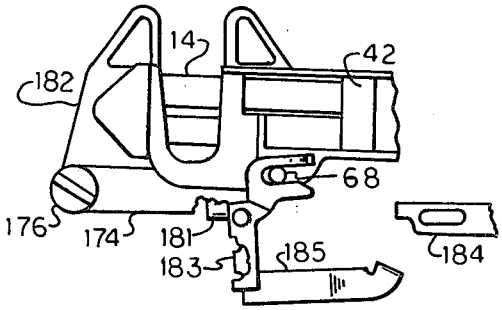
FIG. 11 is a front elevational view of the cartridge arm located in the upper case non-print position.
Figure 10:
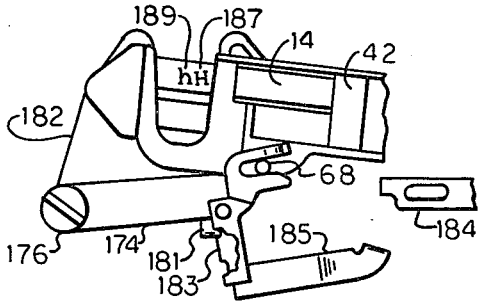
FIG. 10 is a front elevational view of the cartridge arm located in the lower case print position.

Referring to FIG. 7, the ribbon lift mechanism 70 is connected to the arm 42 of the cartridge 16 to lift the ribbon 14 to the printing position and to lower the ribbon 14 from the printing position. The ribbon lift mechanism 70 has an actuator 158 connected to a shaft 159 by a link 162. The actuator 158 has a cam surface 164. A bellcrank 166 is pivotally supported on a post 168. A pin 170 is rigidly connected at one end of the bellcrank 166. A spring 172 is connected at one end to the actuator 158 and at the other end to the pin 170. The spring 172 biases the pin 170 against the cam surface 164. A ribbon lifter 174 is pivotally supported on a shouldered screw 176. A link 178 connects the bellcrank 166 to the ribbon lifter 174. The ribbon lifter 174 has a slot 180 for receiving the pin 68 on the cartridge arm 42 when the cartridge 16 is inserted on the cartridge support 18. An upstop 181 is formed from a card holder 182 which is rigidly attached to the bracket 144. A finger 183 carried by the ribbon lifter 174 contacts the upstop 181 to limit the lifting movement of the ribbon lifter 174 when printing a lower case character 22 (FIG. 10). Another upstop 184 is rigidly attached to a fixed member (not shown) on the typewriter. An arm 185 carried by the ribbon lifter 174 contacts the upstop 184 to limit the lifting movement of the ribbon lifter 174 when printing an upper case charater 24 (FIG. 12).

When a printing mechanism 20 is actuated, an actuator 88 drives a universal bail 266 forward which pivots an arm 260 clockwise (FIg. 7) about the shaft 90. The arm 260 pulls the link 163 forward which pivots the shaft 159 clockwise. The shaft 159 drives the actuator 158 through the link 162 toward the left. The actuator 158 pulls one end of the spring 172. The spring 172 pivots the bellcrank 166 clockwise about the post 168 by continually biasing the pin 170 against the cam surface 164. The bellcrank 166 lifts the ribbon lifter 174 which lifts the arm 42 and the ribbon 14 to the printing position. If the carriage 10 is in the lower case position, the ribbon lifter 174 will be lifted to abut against the lower case upstop 181 (FIG. 10). If the carriage 10 is in the upper case position, the ribbon lifter 174 will be lifted to abut against the upper case upstop 184 (FIG. 12).

Figure 12:
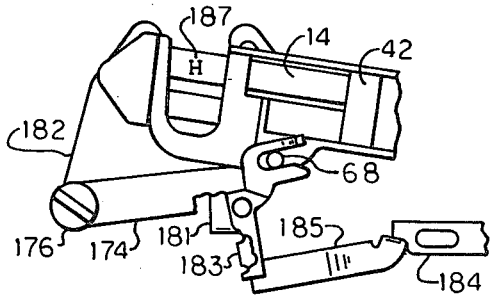
FIG. 12 is a front elevational view of the cartridge arm located in the upper case print position.

Referring to FIG. 12, when an upper case character 187 is printed, the character 187 strikes the ribbon 14 at an angle relative to the length of the ribbon 14. As shown in FIG. 10, when the carriage 10 is returned to the lower case position and a lower case character 189 is printed, the character 189 strikes the ribbon 14 at a position slightly spaced away from the upper case character 187 due to the increment ribbon feed movement when the carriage 10 shifted from the upper case position to the lower case position. Therefore, overlapping of printed characters on the ribbon 14 is avoided.

RIBBON FEED MECHANISM

The ribbon feed mechanism 26 is operable to incrementally feed the ribbon 14 in response to actuating the printing mechanism 20 (FIG. 2) and in response to actuating the carriage shift mechanism 12 (FIG. 3).

Referring to FIG. 1, the ribbon feed mechanism 26 has a linkage 28 connected to the ribbon 14. The linkage 28 has an actuator 186 pivotally supported on the shaft 90. A pawl 188 is pivotally supported on the actuator 186 near one end. A spring 190 biases the pawl 188 to a limited position in a counter-clockwise direction. A pin 192 is rigidly attached to the actuator 186 near a second end. A bellcrank 194 is pivotally supported on a post 196. An arm 198 on the bellcrank 194 is positioned against the pin 192 on the actuator 186. A link 200 is connected at one end to a second arm 202 on the bellcrank 194. The link 200 is connected at the other end to an arm 204. The arm 204 is pivotally supported on the shaft 58 and is connected to the shaft 58 by a one-way spring clutch 206. A spring 208 is connected at one end to a rigid bracket 210 and is connected at the other end to the arm 204 for biasing the arm 204 in a counter-clockwise direction about the shaft 58. A toothed member 212 is rigidlly attached to the shaft 58. Each tooth 214 has a first cam surface 216 and a second cam surface 218. Two adjacent teeth 214 form a valley 220 therebetween. An arm 222 is pivotally supported on a post 224. A roller 226 is pivotally supported at an end of the arm 222. A spring 228 is connected at one end to the arm 222 and is connected at the other end to the bracket 210. The spring 228 biases the roller 226 into the valley 220 on the toothed member 212.

The ribbon feed mechanism 26 includes the power roll 106 located adjacent the actuator 186 and the pawl 188 to act as the power source 30 for driving the linkage 28.

The control means 34 is operable to couple the linkage 28 to the power roll 106 in response to the actuation of the printing mechanism 20 and in response to the carriage shift mechanism 12. The control means 34 has a bellcrank 230 pivotally supported on a post 232. A spring 234 is connected at one end to the frame 150 and is connected at the other end to a downward extending arm 236 of the bellcrank 230. The bellcrank 230 has an integral abutment 238 positioned adjacent the pawl 188. The bellcrank 230 has an integral finger 240 located between the abutment 238 and the post 232. A bellcrank 242 is pivotally supported on a post 244. A first integral arm 246 extends rearward from the bellcrank 242. A second integral arm 248 extends rearward from the bellcrank 242. A third integral arm 250 extends upward from the bellcrank 242. The third integral arm 250 has an integral step portion 252 near its free end. The bellcrank 242 has a spring anchor 254 integrally formed therefrom. A spring 256 is connected at one end to a post 258 rigidly attached to the frame 150. The spring 256 is connected at the other end to the spring anchor 254. The spring 256 biases the bellcrank 242 clockwise (FIG. 1) about the post 244 to a limited position determined by the third integral arm 250 abutting against the finger 240 of the bellcrank 230. The spring 234 biases the bellcrank 230 counter-clockwise about the post 232 to a limited position determined by the finger 240 abutting against the step portion 252 on the third integral arm 250.

The arm 260 is pivotally supported on the shaft 90. A spring 262 is connected at one end to a spring anchor 264 and is connected at the other end to the arm 260. The spring 262 biases the arm 260 clockwise about the shaft 90. The universal bail 266 has one end rigidly attached to the arm 260. The universal bail 266 extends across the typewriter and is located adjacent the actuator 88 of each printing mechanism 20. A pin 268 is rigidly attached to the arm 260 in a direction opposite from the universal bail 266 and is located adjacent the first integral arm 246 of the bellcrank 242. A link 270 is connected at a forward end to the arm 236 of the bellcrank 230 by a shoulder pin 272. A pin 274 is rigidly connected to the bellcrank 194. The pin 274 extends through an elongated slot 276 in the rearward end of the link 270. A lever 278 is pivotally supported on the post 244. The lever 278 has a first integral finger 280 and a second integral finger 282 extending upward. A spring 284 is connected at one end to the spring anchor 254 and is connected at the other end to the lever 278. The spring 284 biases the finger 280 of the lever 278 against the third integral arm 250 of the bellcrank 242. The finger 282 of the lever 278 extends upward to a position adjacent the finger 240 of the bellcrank 230. A post 288 (FIG. 3) is rigidly attached to a clutch plate 290 of the clutch 130 and is located adjacent the second integral arm 248 of the bellcrank 242.

The linkage 28 powered by the power roll 106 is operable to incrementally feed the ribbon 14 in response to actuation of the printing mechanism 20 and in response to actuation of the carriage shift mechanism 12. This arrangement provides an economical and an efficient ribbon feed mechanism 26 operable by two distinct typewriter features such as a printing mechanism and a carriage shift mechanism. The operation of the linkage 28 powered by the power roll 106 will now be described. Referring to FIG. 1, when the pawl 188 is pivoted into engagement with the power roll 106, the power roll 106 pivots the actuator 186 counter-clockwise about the shaft 90. The pin 192 on the actuator 186 pivots the bellcrank 194 clockwise about the post 196. The bellcrank 194 pulls the link 200 forward which pivots the arm 204 clockwise about the shaft 58. The arm 204 drives the spring clutch 206 which drives the shaft 58 clockwise. The shaft 58 rotates the toothed member 212 an amount sufficient to drive the roller 226 up the first cam surface 216 slightly over the apex of the tooth 214 and on to the second cam surface 218. Each tooth 214 has identical first and second cam surfaces 216 and 218 with an apex therebetween. When the roller 226 has reached the second cam surface 218, the pawl 188 disengages from the power roll 106. The biasing force of the spring 228 on the roller 226 causes the roller 226 to drive down the second cam surface 218 toward the axis of the shaft 58 thereby continuing the rotation of the toothed member 212 until the roller 226 seats in the valley 220 between two adjacent teeth 214. The total rotation of the toothed member 212 by the arm 204 and by the roller 226 is transmitted to the drive roller 48. With the ribbon 14 located between the drive roller 48 and the pinch roller 46, the ribbon 14 is fed one increment from the supply spool 36 and wound on to the take-up spool 52.

When the pawl 188 disengages from the power roll 106, the biasing force of the spring 208 pivots the arm 204 counter-clockwise about the shaft 58. The arm 204 drives the link 200 rearward which pivots the bellcrank 194 counter-clockwise about the post 196. The bellcrank 194 pivots the actuator 186 clockwise about the shaft 90. The linkage 28 is thereby restored to its non-operative position.

The operation of the control means 34 will now be described. When the printing mechanism 20 is actuated, the actuator 88 engages the universal bail 266 and pivots the arm 260 counter-clockwise about the shaft 90. The pin 268 carried by the arm 260 engages the first integral arm 246 of the bellcrank 242 and pivots the bellcrank 242 counter-clockwise about the post 244. The step portion 252 on the third integral arm 250 is removed from under the finger 240 of the bellcrank 230. The spring 234 biases the bellcrank 230 counter-clockwise about the post 232. The abutment 238 on the bellcrank 230 contacts and pivots the pawl 188 into engagement with the power roll 106. The power roll 106 drives the linkage 28 to feed the ribbon 14 one increment.

During the printing operation of the printing mechanism 20, the pawl 188 disengages from the power roll 106. The spring 262 biases the universal bail 266 clockwise about the shaft 90 which removes the pin 268 from the first integral arm 246. The spring 256 biases the bellcrank 242 clockwise about the post 244 until the third integral arm 250 abuts against the finger 240 of the bellcrank 230.

During the ribbon feeding operation of the linkage 28, the pin 274 carried by the bellcrank 194 moves to the end of the slot 276 in the link 270 and drives the link 270 rearward. The forward end of the link 270 pivots the bellcrank 230 clockwise about the post 232 which returns the finger 240 to abut against the step portion 252 on the third integral arm 250.

Referring to FIGS. 3 and 6, during the operation of the carriage shift mechanism 12, the post 288 is carried by the clutch plate 290 clockwise about the shaft 132 to engage the second integral arm 248 of the bellcrank 242 and pivots the bellcrank 242 clockwise about the post 244. The post 288 is located on the clutch plate 290 to pivot the bellcrank 242 only when the carriage 10 is shifted from the upper case position, the post 28 shown in solid lines in FIG. 6, to the lower case position, the post 288 shown in broken lines in FIG. 6. Pivoting the bellcrank 242 clockwise removes the step portion 252 from under the finger 240 of the bellcrank 230. The spring 234 biases the bellcrank 230 clockwise about the post 232. The abutment 238 on the bellcrank 230 contacts and pivots the pawl 188 into engagement with the power roll 106. The power roll 106 drives the linkage 28 to feed the ribbon 14 one increment. The bellcrank 242 and the bellcrank 230 are returned to their non-operative positions in the same manner previously described.

When the bellcrank 242 is pivoted clockwise by either the first integral arm 246 or the second integral arm 248 and the bellcrank 230 is pivoted clockwise by the spring 234, the lever 278 is pivoted clockwise about the post 244 by the spring 284 until the upper end of the finger 282 abuts against an edge 292 of the finger 240. If the bellcrank 230 is pivoted counter-clockwise about the post 232 by the link 270 before the third integral arm 250 returns counter-clockwise to position the step portion 252 under the finger 240, then the extreme end 294 of the finger 282 is positioned below the finger 240 by the spring 284. The finger 240 is then biased against the end 294 of the finger 282 to hold the bellcrank 230 in the returned counter-clockwise position. When the third integral arm 250 is returned counter-clockwise by the spring 256, the third integral arm 250 being in contact with the finger 280, pivots the lever 278 counter-clockwise which drives the end 294 from under the finger 240. The clockwise movement of the third integral arm 250 simultaneously positions the step portion 252 under the finger 240 thereby holding the bellcrank 230 in the non-operated position.

SUMMARY

The present ribbon feed mechanism 26 prevents overlap printing of characters on the carbon ribbon 14 by feeding the ribbon 14 one increment when shifting the carriage 10 from the upper case position to the lower case position. This feeding of the ribbon 14 during carriage shift is in addition to the usual practice of feeding the ribbon 14 by the printing mechanism 20.

The present ribbon feed mechanism 26 is an economical and effecient mechanism by having the same linkage 28 powered by the same power roll 106 for incrementally feeding the ribbon 14 in response to the actuation of the printing mechanism 20 and in response to the actuation of the carriage shift mechanism 12.

What is claimed is:

1. A ribbon feed mechanism for a typewriter having a carriage shiftable between a lower case position for printing lower case characters and an upper case position for printing upper case characters, a carriage shift mechanism for shifting the carriage between the lower and the upper case positions, a ribbon supported for incremental feeding movement, and a printing mechanism for striking the ribbon for printing the lower and upper case characters, the ribbon feed mechanism comprising:

a power source;

a linkage operatively connected to the ribbon for incrementally feeding the ribbon when coupled to the power source;

a control means actuated by the printing mechanism during a printing operation for coupling the linkage to the power source for incrementally feeding the ribbon, and the control means actuated by the carriage shift mechanism during a carriage shift operation for coupling the linkage to the power source for incrementally feeding the ribbon.

2. The ribbon feed mechanism as defined in claim 1 wherein the carriage shift mechanism includes a rotatable plate and a post supported on the plate in a position to be ineffective during shifting the carriage from the lower case position to the upper case position and to be effective during shifting the carriage from the upper case position to the lower case position to actuate the control means for coupling the linkage to the power source for incrementally feeding the ribbon.

3. The ribbon feed mechanism as defined in claim 1 wherein the control means includes a control member actuated by the printing mechanism during a printing operation for coupling the linkage to the power source, and the control member actuated by the carriage shift mechanism during a carriage shift operation for coupling the linkage to the power source.

4. The ribbon feed mechanism as defined in claim 3 wherein the carriage shift mechanism includes a post operable to actuate the control member when shifting the carriage from the upper case position to the lower case position for incrementally feeding the ribbon.

5. The ribbon feed mechanism as defined in claim 3 wherein the control member has a first arm, the printing mechanism has a pin positioned adjacent the first arm, the pin being operable to contact and actuate the first arm during a printing operation for coupling the linkage to the power source for incrementally feeding the ribbon.

6. The ribbon feed mechanism as defined in claim 5 wherein the control member has a second arm, the carriage shift mechanism has a post positioned adjacent the second arm, the post being operable to contact and actuate the second arm during a carriage shift operation for coupling the linkage to the power source for incrementally feeding the ribbon.

7. A ribbon feed mechanism as defined in claim 1 wherein the control means includes a bellcrank operable from an ineffective position to an effective position for driving the linkage into engagement with the power source, a control member having a holding position for holding the bellcrank in the ineffective position, the control member actuated from the holding position by the printing mechanism during a printing operation and actuated from the holding position by the carriage shift mechanism during a carriage shift operation for releasing the bellcrank for movement from the ineffective position to the effective position.

8. A ribbon feed mechanism as defined in claim 7 wherein the control means includes a spring connected to the bellcrank for moving the bellcrank from the ineffective position to the effective position.

9. A ribbon feed mechanism as defined in claim 7 further comprises a link connecting the linkage to the bellcrank for returning the bellcrank from the effective position to the ineffective position while the linkage is incrementally feeding the ribbon.

10. A ribbon feed mechanism as defined in claim 9 wherein the control means includes a lever for holding the bellcrank in the ineffective position when returned to the ineffective position by the link, and the control means includes a means for returning the control member to the holding position for releasing the lever from the bellcrank and for engaging the bellcrank to hold the bellcrank in the ineffective position.

* * * * *